US011635241B2

(12) United States Patent
Richard et al.

(10) Patent No.: US 11,635,241 B2
(45) Date of Patent: Apr. 25, 2023

(54) CONTAINER REFRIGERATION MONITORING SYSTEMS AND METHODS

(71) Applicant: Emerson Climate Technologies, Inc., Sidney, OH (US)

(72) Inventors: Karen R. Richard, Versailles, OH (US); Abram A. Yorde, Englewood, OH (US); Paul L. Fullenkamp, Versailles, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 464 days.

(21) Appl. No.: 16/773,119

(22) Filed: Jan. 27, 2020

(65) Prior Publication Data

US 2020/0240691 A1 Jul. 30, 2020

Related U.S. Application Data

(60) Provisional application No. 62/797,470, filed on Jan. 28, 2019.

(51) Int. Cl.
*F25B 49/02* (2006.01)

(52) U.S. Cl.
CPC ..... *F25B 49/02* (2013.01); *F25B 2500/19* (2013.01); *F25B 2700/15* (2013.01);
(Continued)

(58) Field of Classification Search
CPC .. F25B 49/02; F25B 2500/19; F25B 2700/15; F25B 2700/1931; F25B 2700/1933;
(Continued)

(56) References Cited

U.S. PATENT DOCUMENTS 7,002,472 B2 2/2006 Stratmoen et al.
7,134,291 B2 11/2006 Horan et al.
(Continued)

FOREIGN PATENT DOCUMENTS

EP 1151428 B1 11/2002
EP 2338029 B1 6/2011
(Continued)

OTHER PUBLICATIONS

Slocum, Hannah "IBM Food Trust Expands Blockchain Network to Foster a Safer, More Transparent and Efficient Global Food System: IBM Announces General Availability of IBM Food Trust as Carrefour Joins Major Supermarkets and Consumer Goods Leaders Momentum Grows Among Users and Third-Party Data Suppliers on the Network", IBM Press Tools—Announcements; Armonk, N.Y. and Paris, Oct. 8, 2018/PRNewswire/<https://newsroom.ibm.com/2018-10-08-IBM-Food-Trust-Expands-Blockchain-Network-to-Foster-a-Safer-More-Transparent-and-Efficient-Global-Food-System-1?printable>.
(Continued)

*Primary Examiner* — Larry L Furdge
(74) *Attorney, Agent, or Firm* — Harness, Dickey & Pierce, P.L.C.

(57) ABSTRACT

A system for monitoring health of refrigerated storage containers includes an instantaneous health module configured to determine instantaneous health values for a refrigerated storage container based on parameters measured by sensors of a refrigeration system of the refrigerated storage container during a trip of the refrigerated storage container. A statistics module is configured to, after completion of the trip of the refrigerated storage container, determine statistical values based on the instantaneous health values determined for the trip. A health module is configured to determine an overall health value for the refrigerated storage
(Continued)

container at the completion of the trip based on the statistical values and to store the overall health value for the refrigerated storage container in memory in association with a unique identifier of the refrigerated storage container.

20 Claims, 8 Drawing Sheets

(52) U.S. Cl.
CPC ..... *F25B 2700/1931* (2013.01); *F25B 2700/1933* (2013.01); *F25B 2700/2116* (2013.01); *F25B 2700/2117* (2013.01); *F25B 2700/21151* (2013.01); *F25B 2700/21152* (2013.01)

(58) Field of Classification Search
CPC .. F25B 2700/21151; F25B 2700/21152; F25B 2700/2116; F25B 2700/2117; F25B 2400/13; F25B 2400/23; F25B 49/00; F25D 29/003
See application file for complete search history.

(56) References Cited

U.S. PATENT DOCUMENTS

| | | | | |
|---|---|---|---|---|
| 7,444,251 | B2 | 10/2008 | Nikovski et al. | |
| 7,482,920 | B2 | 1/2009 | Joao | |
| 7,883,013 | B2 | 2/2011 | Skaaksrud et al. | |
| 8,126,642 | B2 | 2/2012 | Trepagnier et al. | |
| 8,280,682 | B2 | 10/2012 | Vock et al. | |
| 8,339,251 | B2 | 12/2012 | Roberts, Sr. et al. | |
| RE43,990 | E | 2/2013 | Golden | |
| 8,666,316 | B2 | 3/2014 | Hoerdum et al. | |
| 8,849,723 | B2 | 9/2014 | Robinson et al. | |
| 9,008,828 | B2 | 4/2015 | Worsley | |
| 9,147,175 | B2 | 9/2015 | Schmidt et al. | |
| 9,264,905 | B2 | 2/2016 | Ferguson-Jarnes et al. | |
| 9,366,451 | B2 | 6/2016 | Guo et al. | |
| 9,714,781 | B2 * | 7/2017 | Ueno | H02H 7/0852 |
| 9,847,029 | B2 | 12/2017 | Joao | |
| 9,870,662 | B2 | 1/2018 | Mullane et al. | |
| 9,971,366 | B2 | 5/2018 | Thogersen et al. | |
| 9,972,154 | B1 | 5/2018 | Meyers | |
| 9,992,623 | B2 | 6/2018 | Skaaksrud | |
| 10,057,722 | B2 | 8/2018 | Skaaksrud | |
| 10,149,104 | B2 | 12/2018 | Skaaksrud | |
| 10,152,876 | B2 | 12/2018 | Joao | |
| 10,181,109 | B2 | 1/2019 | Joao | |
| 11,115,456 | B2 * | 9/2021 | Root | G16H 50/20 |
| 2012/0252488 | A1 | 10/2012 | Hartmann et al. | |
| 2013/0304261 | A1 * | 11/2013 | Vass | F24F 11/00 708/251 |
| 2014/0052888 | A1 * | 2/2014 | Wagner | F25D 29/003 702/50 |
| 2014/0056536 | A1 * | 2/2014 | Zamyatin | G06T 5/002 382/275 |
| 2015/0205308 | A1 | 7/2015 | Huat | |
| 2016/0216028 | A1 | 7/2016 | Jonsson et al. | |
| 2017/0351844 | A1 * | 12/2017 | Lee | G16H 70/00 |
| 2018/0032972 | A1 * | 2/2018 | Osborn | G06Q 10/20 |
| 2018/0106261 | A1 * | 4/2018 | Zhang | G01M 3/00 |
| 2018/0144430 | A1 | 5/2018 | Millhouse et al. | |
| 2018/0150798 | A1 | 5/2018 | Wilkinson et al. | |
| 2018/0194195 | A1 | 7/2018 | Bryant et al. | |
| 2018/0347895 | A1 * | 12/2018 | Jonsson | F25D 29/008 |
| 2019/0156268 | A1 | 5/2019 | Joao | |
| 2019/0250653 | A1 | 8/2019 | Conlon | |
| 2019/0286152 | A1 | 9/2019 | Skaaksrud et al. | |

FOREIGN PATENT DOCUMENTS

| | | | |
|---|---|---|---|
| EP | 3144867 | A1 | 3/2017 |
| JP | 2005291702 | A | 10/2005 |
| KR | 20090045596 | A | 5/2009 |
| WO | WO-2019043446 | A1 | 3/2019 |
| WO | WO-2019157534 | A1 | 8/2019 |

OTHER PUBLICATIONS

International Search Report of the ISA regarding Application No. PCT/US2020/015423 dated May 28, 2020.
Written Opinion of the ISA regarding Application No. PCT/US2020/015423 dated May 28, 2020.

* cited by examiner

CONTAINER REFRIGERATION MONITORING SYSTEMS AND METHODS

CROSS-REFERENCE TO RELATED APPLICATIONS

This application claims the benefit of U.S. Provisional Patent Application No. 62/797,470, filed on Jan. 28, 2019. The entire disclosure of the application referenced above is incorporated herein by reference.

FIELD

The present disclosure relates to refrigeration systems and more particularly to systems and methods for monitoring refrigeration systems of portable refrigerated storage containers.

BACKGROUND

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Compressors may be used in a wide variety of industrial and residential applications to circulate refrigerant to provide a desired heating or cooling effect. For example, a compressor may be used to provide heating and/or cooling in a refrigeration system, a heat pump system, a heating, ventilation, and air conditioning (HVAC) system, or a chiller system. These types of systems can be fixed, such as at a building or residence, or can be mobile, such as transported by vehicle. Vehicles include land based vehicles (e.g., trucks, cars, trains, etc.), water based vehicles (e.g., boats/ships), air based vehicles (e.g., airplanes), and vehicles that operate over/on a combination of more than one of land, water, and air. Refrigeration systems can be used, for example, in medical refrigerators, refrigerated beverage dispensers, frozen dessert dispensers, etc.

SUMMARY

In a feature, a system for monitoring health of refrigerated storage containers is described. An instantaneous health module is configured to determine instantaneous health values for a refrigerated storage container based on parameters measured by sensors of a refrigeration system of the refrigerated storage container during a trip of the refrigerated storage container. A statistics module is configured to, after completion of the trip of the refrigerated storage container, determine statistical values based on the instantaneous health values determined for the trip. A health module is configured to determine an overall health value for the refrigerated storage container at the completion of the trip based on the statistical values and to store the overall health value for the refrigerated storage container in memory in association with a unique identifier of the refrigerated storage container.

In further features, the parameters measured by the sensors include at least two of: a condenser temperature measured by a condenser temperature sensor of the refrigeration system; a discharge line temperature measured by a discharge line temperature sensor of the refrigeration system; a return air temperature measured by a return air temperature sensor of the refrigeration system; a supply air temperature measured by a supply air temperature sensor of the refrigeration system; an evaporator temperature measured by an evaporator temperature sensor of the refrigeration system; a suction temperature measured by a suction temperature sensor of the refrigeration system; a suction pressure measured by a suction pressure sensor of the refrigeration system; a discharge pressure measured by a discharge pressure sensor of the refrigeration system; a line current input to the refrigeration system; a voltage input to the refrigeration system; and a frequency of a voltage input to the refrigeration system.

In further features, the parameters measured by the sensors include all of: a condenser temperature measured by a condenser temperature sensor of the refrigeration system; a discharge line temperature measured by a discharge line temperature sensor of the refrigeration system; a return air temperature measured by a return air temperature sensor of the refrigeration system; a supply air temperature measured by a supply air temperature sensor of the refrigeration system; an evaporator temperature measured by an evaporator temperature sensor of the refrigeration system; a suction temperature measured by a suction temperature sensor of the refrigeration system; a suction pressure measured by a suction pressure sensor of the refrigeration system; a discharge pressure measured by a discharge pressure sensor of the refrigeration system; a line current input to the refrigeration system; a voltage input to the refrigeration system; and a frequency of a voltage input to the refrigeration system.

In further features, the instantaneous health module is configured to determine the instantaneous health values further based on an ambient temperature outside of the refrigerated storage container.

In further features, the instantaneous health module is configured to determine the instantaneous health values further based on a setpoint temperature within the refrigerated storage container.

In further features, the statistical values include: a standard deviation of the instantaneous health values; a geometric mean of the instantaneous health values; a median absolute deviation of the instantaneous health values; and a winsorized standard deviation of the instantaneous health values.

In further features, the statistical values include at least two of: a standard deviation of the instantaneous health values; a median of the instantaneous health values; a geometric mean of the instantaneous health values; a harmonic mean of the instantaneous health values; a kurtosis of the instantaneous health values; a skewness of the instantaneous health values; a median absolute deviation of the instantaneous health values; a mean of the instantaneous health values; a variance of the instantaneous health values; a winsorized mean of the instantaneous health values; a winsorized standard deviation of the instantaneous health values; a pseudo standard deviation of the instantaneous health values; and an inner quartile range of the instantaneous health values.

In further features, a recommendation module is configured to set a recommendation for whether to perform a pre-trip inspection of the refrigerated storage container based on the overall health value of the refrigerated storage container and to store the recommendation in the memory in association with the unique identifier of the refrigerated storage container.

In further features, the recommendation module is configured to: set the recommendation to a first state when the overall health value of the refrigerated storage container is greater than a predetermined value; and set the recommendation to a second state when the overall health value of the refrigerated storage container is less than the predetermined value.

In further features, a communication module is configured to: receive a request including the unique identifier of the refrigerated storage container from a user device via a network; based on the unique identifier included in the request, retrieve the overall health value of the refrigerated storage container and the recommendation for the refrigerated storage container from the memory; and transmit the overall health value and the recommendation to the user device via the network.

In further features, the user device is configured to display at least one of the overall health value of the refrigerated storage container and the recommendation on a display.

In further features, a communication module is configured to: receive a request including the unique identifier of the refrigerated storage container from a user device via a network; based on the unique identifier included in the request, retrieve the overall health value of the refrigerated storage container from the memory; and transmit the overall health value to the user device via the network.

In further features, the user device is configured to display the overall health value of the refrigerated storage container on a display.

In a feature, a method for monitoring health of refrigerated storage containers includes: determining instantaneous health values for a refrigerated storage container based on parameters measured by sensors of a refrigeration system of the refrigerated storage container during a trip of the refrigerated storage container; after completion of the trip of the refrigerated storage container, determining statistical values based on the instantaneous health values determined for the trip; determining an overall health value for the refrigerated storage container at the completion of the trip based on the statistical values; and storing the overall health value for the refrigerated storage container in memory in association with a unique identifier of the refrigerated storage container.

In further features, the method further includes receiving the parameters measured by the sensors, the parameters including at least two of: a condenser temperature measured by a condenser temperature sensor of the refrigeration system; a discharge line temperature measured by a discharge line temperature sensor of the refrigeration system; a return air temperature measured by a return air temperature sensor of the refrigeration system; a supply air temperature measured by a supply air temperature sensor of the refrigeration system; an evaporator temperature measured by an evaporator temperature sensor of the refrigeration system; a suction temperature measured by a suction temperature sensor of the refrigeration system; a suction pressure measured by a suction pressure sensor of the refrigeration system; a discharge pressure measured by a discharge pressure sensor of the refrigeration system; a line current input to the refrigeration system; a voltage input to the refrigeration system; and a frequency of a voltage input to the refrigeration system.

In further features, determining the instantaneous health values includes determining the instantaneous health values further based on at least one of an ambient temperature outside of the refrigerated storage container and a setpoint temperature within the refrigerated storage container.

In further features, determining the statistical values includes determining at least two of: a standard deviation of the instantaneous health values; a median of the instantaneous health values; a geometric mean of the instantaneous health values; a harmonic mean of the instantaneous health values; a kurtosis of the instantaneous health values; a skewness of the instantaneous health values; a median absolute deviation of the instantaneous health values; a mean of the instantaneous health values; a variance of the instantaneous health values; a winsorized mean of the instantaneous health values; a winsorized standard deviation of the instantaneous health values; a pseudo standard deviation of the instantaneous health values; and an inner quartile range of the instantaneous health values.

In further features, the method further includes: setting a recommendation for whether to perform a pre-trip inspection of the refrigerated storage container based on the overall health value of the refrigerated storage container; and storing the recommendation in the memory in association with the unique identifier of the refrigerated storage container.

In further features, the method further includes: receiving a request including the unique identifier of the refrigerated storage container from a user device via a network; based on the unique identifier included in the request, retrieving the overall health value of the refrigerated storage container and the recommendation for the refrigerated storage container from the memory; and transmitting the overall health value and the recommendation to the user device via the network.

In further features, the method further includes, on a display of the user device, at least one of the overall health value of the refrigerated storage container and the recommendation on a display.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

Portable storage containers are used to transport various different types of goods over different surfaces. Portable refrigerated storage containers are used to transport various types of cooled goods (e.g., perishable foods) by sea (via ship). Refrigerated storage containers are loaded onto a ship via a crane and unloaded from the ship via a crane.

Each time that a refrigerated storage container completes a trip, the goods are unloaded from the refrigerated storage container. The refrigerated storage container may be subjected to a visual inspection to determine whether to perform a more comprehensive pre-trip inspection before being loaded with new goods for a next trip.

The visual inspection, however, is time consuming, introduces the possibility of error, and is generally performed by a human.

The present disclosure references a system that monitors parameters of a refrigerated storage container during a trip. Based on the parameters obtained during the trip, the system determines a value that corresponds to a likelihood that the refrigerated storage container can properly complete a next trip without a pre-trip inspection and/or any repairs. Based on the value at the completion of the trip, the refrigerated storage container can either be: allowed to be packed for a next trip without a pre-trip inspection and without repairs; or subjected to a pre-trip inspection and/or repairs. The value at the completion of a trop may be used in a variety of logistic scenarios, such as ranking of system fitness for a next trip, identify which systems of a fleet are most in need of repair to increase performance, etc.

Figure 1:
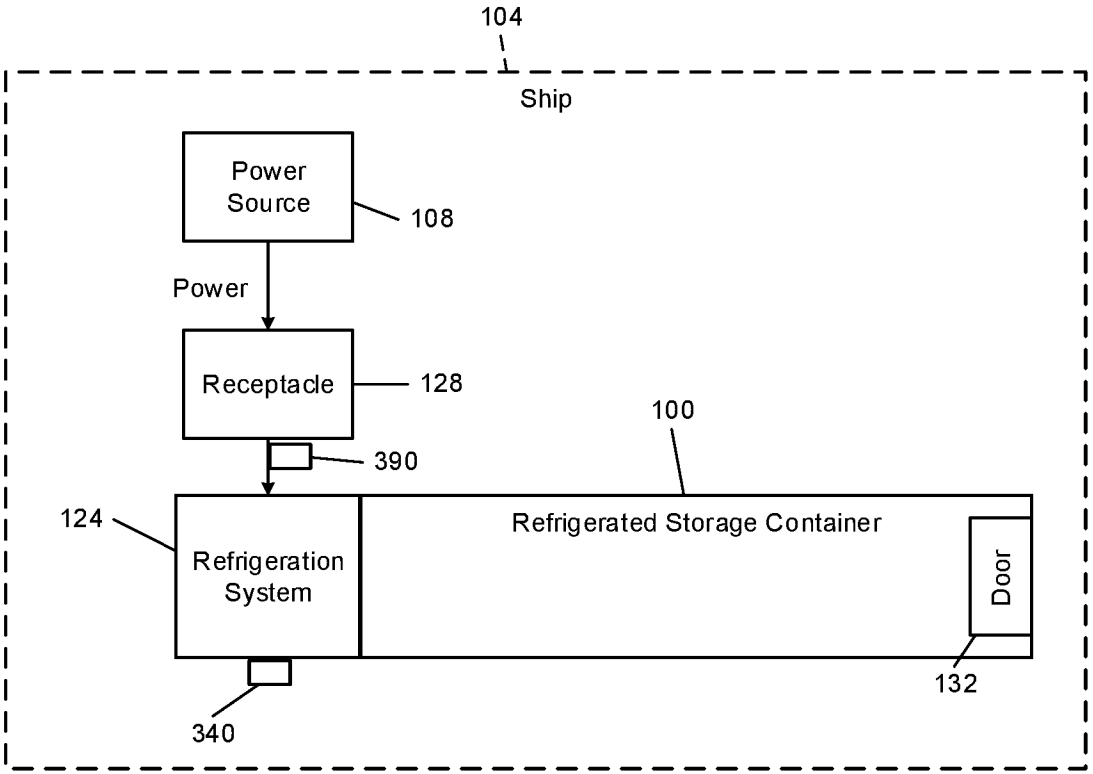
FIG. 1 is a functional block diagram including a portable refrigerated storage container located on a ship.

FIG. 1 is a functional block diagram including a portable refrigerated storage container 100 located on a ship 104. While the example of a ship is provided, the present application is also applicable to other types of marine vessels, land based vehicles, and aircraft. The refrigerated storage container 100 may be, for example, 20 feet long, 40 feet long, or another suitable length.

The ship 104 includes a power source 108 that supplies electrical power to refrigerated storage containers located on the ship 104, such as the refrigerated storage container 100. The power source 108 may include, for example, one or more generators driven by one or more engines of the ship 104, one or more batteries, and/or one or more other suitable sources of electrical power.

The ship 104 may be configured to transport N refrigerated storage containers, where N is an integer greater than 1. In various implementations, N may be greater than 1, such as 100, 500, 1,000, etc. Refrigerated storage containers are loaded onto the ship 104 and offloaded from the ship 104 via crane.

The refrigerated storage container 100 includes a refrigeration system 124 that receives electrical power via a receptacle 128. The receptacle 128 may be configured to receive alternating current (AC) or direct current (DC) power from the power source 108. For example, the receptacle 128 may be configured to receive AC power from the power source 108 via a power cord or cable connected between the receptacle 128 and the power source 108. The receptacle 128 may be, for example, a single phase 110/120 or 208/240 V AC receptacle or a 3-phase 208/240 V AC receptacle. In various implementations, the refrigerated storage container 100 may include two or more different types of receptacles for receiving two or more different types of electrical power.

The refrigeration system 124 cools air and items located within the refrigerated storage container 100 such that a (air) temperature within the refrigerated storage container 100 remains at or less than a setpoint temperature. The setpoint temperature may be set based on user input and may be set based on the items within the refrigerated storage container 100. For example, the setpoint temperature may be set to a lower temperature for frozen perishable items and may be set to a higher temperature for non-frozen perishable items. A user may vary the setpoint temperature via one or more user input devices, such as one or more user input devices located on an exterior or an interior of the refrigerated storage container 100.

The refrigerated storage container 100 includes one or more doors, such as door 132, that provide access to the interior of the refrigerated storage container 100, for example, for loading or unloading of items to the interior of the refrigerated storage container 100. While the example of only one door is shown, the refrigerated storage container 100 may include more than one door. In various implementations, the refrigerated storage container 100 may be partitioned into two or more separate spaces. In such implementations, the refrigeration system 124 cools air and items located within the spaces such that (air) temperatures within the spaces remain at or less than respective setpoint temperatures.

As discussed further below, the refrigeration system 124 includes an electric variable speed compressor. The variable speed compressor is driven via electrical power applied to an electric motor of the variable speed compressor. A control module controls operation of the variable speed compressor to maintain the temperature within the refrigerated storage container 100 at or below the setpoint temperature.

Figure 2:
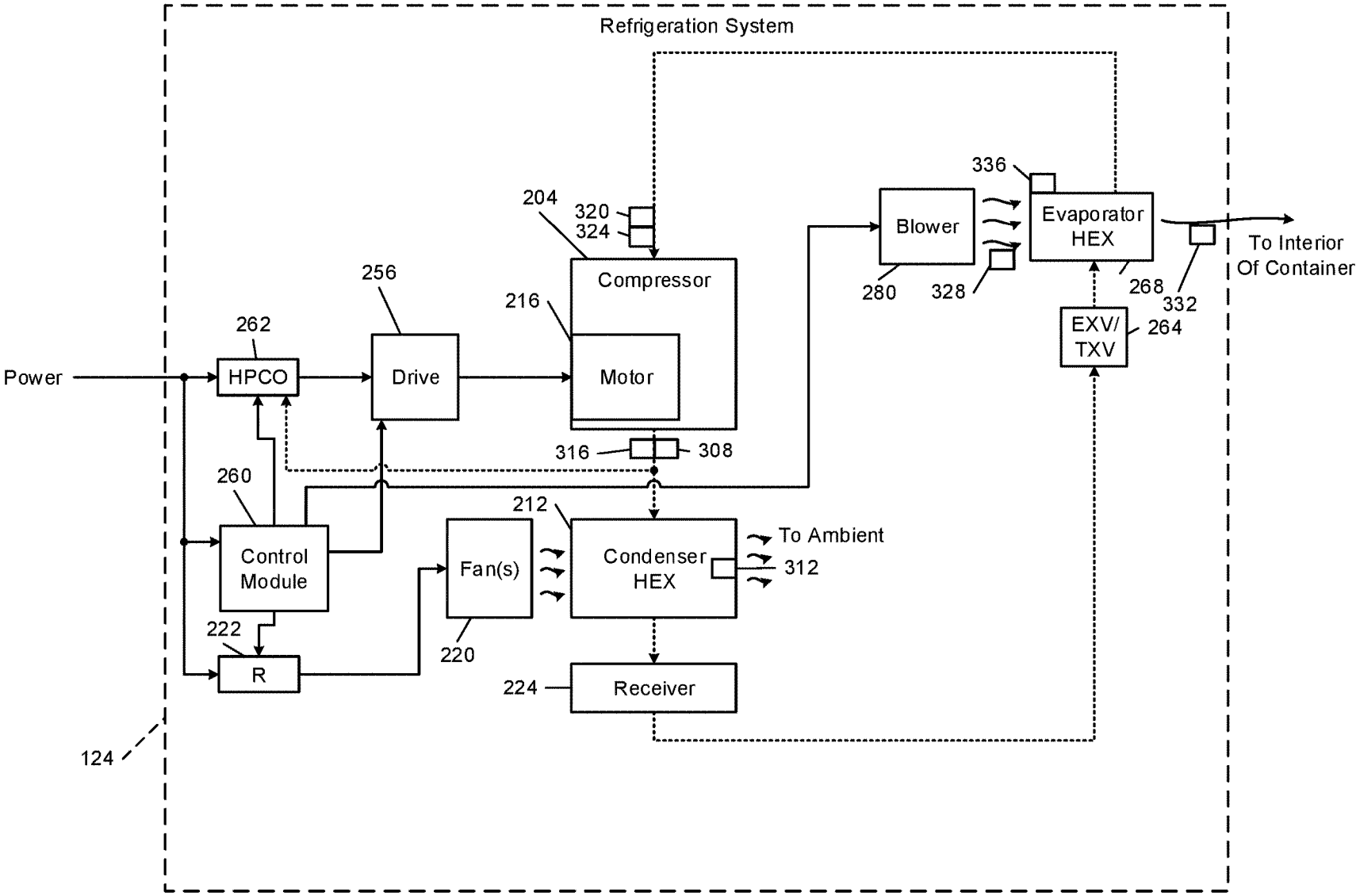
FIG. 2 includes a functional block diagram of an example implementation of a refrigeration system of a refrigerated storage container.

FIG. 2 includes a functional block diagram of an example implementation of the refrigeration system 124. In the example of FIG. 2, dotted lines indicate refrigerant flow, and solid lines indicate electrical connections and physical connections.

A compressor 204 receives refrigerant vapor via a suction line of the compressor 204. In various implementations, the compressor 204 may receive refrigerant vapor from an accumulator that collects liquid refrigerant to minimize liquid refrigerant flow to the compressor 204.

The compressor 204 compresses the refrigerant and provides pressurized refrigerant in vapor form to a condenser heat exchanger (HEX) 212. The compressor 204 includes an electric motor 216 that drives a pump to compress the refrigerant. For example only, the compressor 204 may include a scroll compressor, a reciprocating compressor, or another type of refrigerant compressor. The electric motor 216 may include, for example, an induction motor, a permanent magnet motor (brushed or brushless), or another suitable type of electric motor. In various implementations, the electric motor 216 may be a brushless permanent magnet (BPM) motor. BPM motors may be more efficient than other types of electric motors. The compressor 204 is a variable speed compressor.

All or a portion of the pressurized refrigerant is converted into liquid form within the condenser HEX 212. The condenser HEX 212 transfers heat away from the refrigerant, thereby cooling the refrigerant. When the refrigerant vapor is cooled to a temperature that is less than a saturation temperature of the refrigerant, the refrigerant transitions into liquid (or liquefied) form.

One or more condenser fans 220 may be implemented to increase airflow over, around, and/or through the condenser HEX 212 and increase the rate of heat transfer away from the refrigerant (e.g., to air passing the condenser HEX 212). Air passing the condenser HEX 212 is from outside of the refrigerated storage container 100.

Refrigerant from the condenser HEX 212 may be delivered to a receiver 224. The receiver 224 may be implemented to store excess refrigerant. In various implementations, the receiver 224 may be omitted. A filter drier may be implemented to remove moisture and debris from the refrigerant. In various implementations, the filter drier may be omitted.

In various implementations, the refrigeration system 124 may include an enhanced vapor injection (EVI) system. The EVI system may expand a portion of the refrigerant from the receiver 224 to vapor form, superheat the vapor refrigerant, and provide the superheated vapor refrigerant to the compressor 204, such as at a midpoint within a compression chamber of the compressor 204. EVI may be performed, for example, to increase capacity and increase efficiency of the refrigeration system 124.

Before flowing to an expansion valve 264, the refrigerant may flow through a drive HEX. The drive HEX draws heat away from a drive 256 (e.g., an inverter drive) and transfers heat to refrigerant flowing through the drive HEX. While the example of the drive being liquid (refrigerant) cooled is provided, liquid cooling may be omitted, and the drive 256 may be air cooled. Air cooling may be active (e.g., via one or more devices) and/or passive (e.g., by conduction and convection). In various implementations, the drive HEX may be omitted.

The drive 256 controls application of power to the electric motor 216 from the power source 108 based on signals from a control module 260. For example, the drive 256 may control application of power to the electric motor 216 based on a compressor speed command from the control module 260. Based on the speed command, the drive 256 may generate three-phase AC power (e.g., 208/240 V AC) from the power output of the power source 108 and apply the three-phase AC power to the electric motor 216. The drive 256 may set one or more characteristics of the three-phase AC power based on the compressor speed command, such as frequency, voltage, and/or current. For example only, the drive 256 may be a variable frequency drive (VFD). The drive 256 may, for example, determine a pulse width modulation (PWM) duty cycle to apply to switches of the drive 256 to generate AC power having the characteristics. In various implementations, one or more electromagnetic interference (EMI) filters may be implemented between the receptacle 128 and the drive 256.

The control module 260 may set the compressor speed command to a plurality of different possible speeds for variable speed operation of the electric motor 216 and the compressor 204. The control module 260 and the drive 256 may communicate, for example, using RS485 Modbus or another suitable type of communication including, but not limited to, controller area network (CAN) bus or analog signaling (e.g., 0-10V signals).

A high pressure cut off (HPCO) 262 may be implemented to disconnect the drive 256 from power and disable the electric motor 216 when a pressure of refrigerant output by the compressor 204 exceeds a predetermined pressure. The control module 260 may also control operation of the compressor 204 based on a comparison of the pressure of refrigerant output by the compressor 204. For example, the control module 260 may shut down or reduce the speed of the compressor 204 when the pressure of refrigerant output by the compressor 204 is less than a second predetermined pressure that is less than or equal to the predetermined pressure used by the HPCO 262.

Refrigerant may be expanded to vapor form by the expansion valve 264 and provided to an evaporator HEX 268. The expansion valve 264 may include a TXV (thermal expansion valve) or may be an EXV (electronic expansion valve).

The evaporator HEX 268 provides cooled air within the refrigerated storage container 100. More specifically, the vapor refrigerant within the evaporator HEX 268 transfers heat away (i.e., absorbs heat) from air passing through the evaporator HEX 268. The evaporator HEX 268 may be implemented within the refrigerated storage container 100 or cooled air may flow from the evaporator HEX 268 to the interior of the refrigerated storage container 100 via ducts.

A blower 280 draws air from within the refrigerated storage container 100. When the blower 280 is on, the blower 280 increases airflow over, around, and/or through the evaporator HEX 268 to increase the rate of heat transfer away from (i.e., cooling of) the air flowing through the evaporator HEX 268 and to increase a cooling rate of the air within the refrigerated storage container 100. Refrigerant from the evaporator HEX 268 flows back to the compressor 204 for a next cycle. Curved lines in FIG. 2 are illustrative of air flow.

The control module 260 may control the speed of the blower 280 in various implementations. For example, the control module 260 may control application of power to electric motors of the blower 280 based on a speed command. Based on the speed command, the control module 260 may generate AC power (e.g., single-phase or three-phase) from the power from the power source 108 and apply the AC power to the electric motor. The control module 260 may set one or more characteristics of the AC power based on the speed command, such as frequency, voltage, and/or current. The control module 260 may, for example, may determine PWM duty cycles to apply to switches of the drive 256 to generate AC power having the characteristics.

The control module 260 may set the speed command to a plurality of different possible speeds for variable speed operation of the blower 280. While the example of the control module 260 applying power to the blower 280 is provided, another module or the drive 256 may apply power to the blower 280. In various implementations, the blower 280 may be a fixed speed blower and the control module 260 may apply power to the electric motor of the blower 280 to operate the blower 280 at the fixed speed or not apply power to the electric motor of the blower 280 such that the blower 280 is off.

Figure 3:
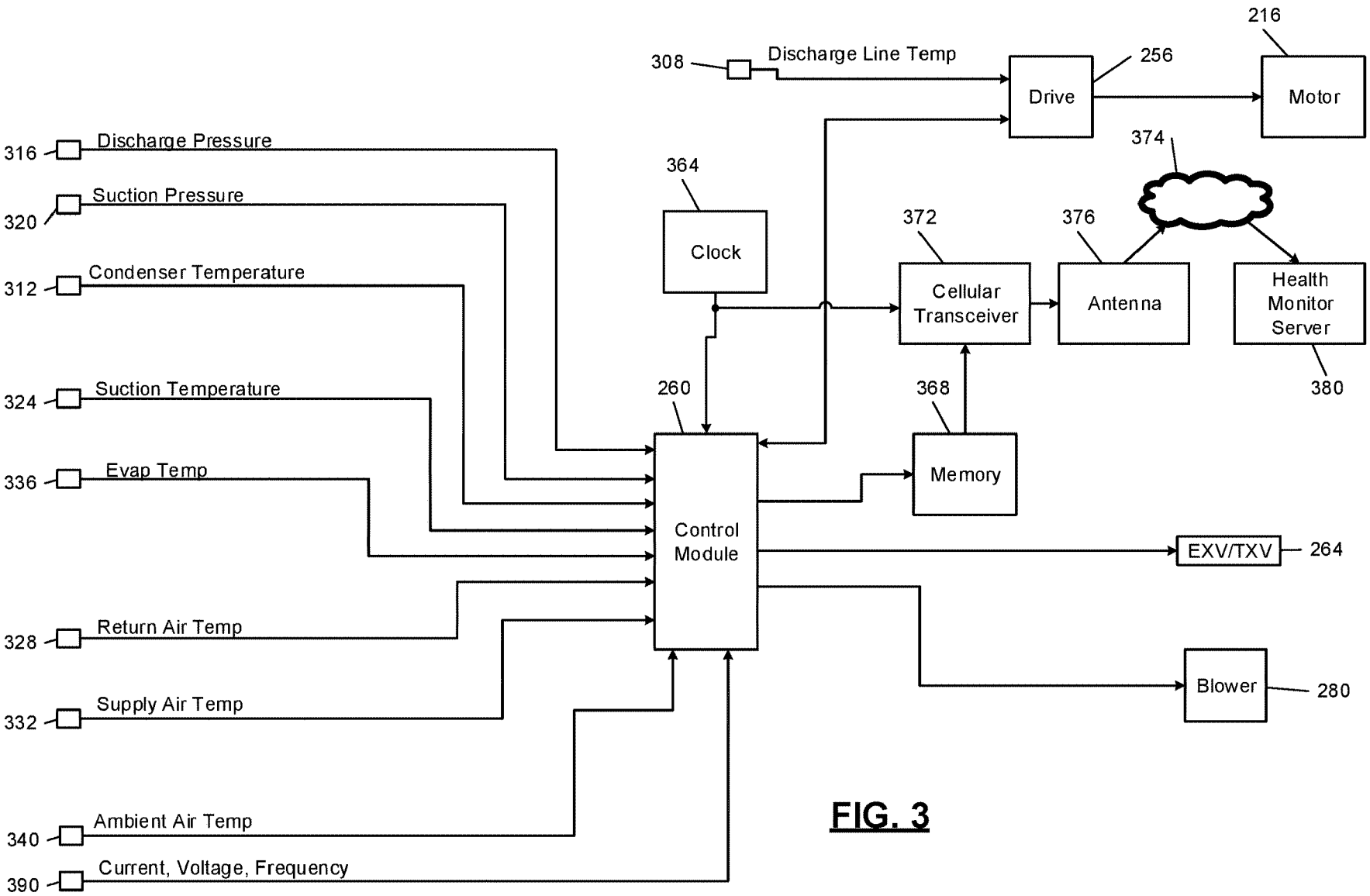
FIG. 3 includes a functional block diagram of an example system including a control module, various sensors, and various actuators of a refrigeration system.

FIG. 3 includes a functional block diagram of an example system including the control module 260, various sensors of the refrigeration system 124, and various actuators of the refrigeration system 124. The control module 260 receives various measured parameters and indications from sensors. The control module 260 controls actuators of the refrigeration system 124, for example, based on measurements from the sensors.

A discharge line temperature (DLT) sensor 308 measures a temperature of refrigerant output by the compressor 204 (e.g., in the discharge line). The temperature of refrigerant output by the compressor 204 can be referred to as discharge line temperature or DLT. The discharge line temperature may be directly provided to the control module 260. Alternatively, the discharge line temperature may be provided to the drive 256 and the drive 256 may communicate the discharge line temperature to the control module 260.

A condenser temperature sensor 312 measures a temperature of liquid refrigerant within the condenser HEX 212. For example, the condenser temperature sensor 312 may measure the temperature of the condenser HEX 212 at or near a midpoint of refrigerant flow through the condenser HEX 212. The temperature of the condenser HEX 212 can be referred to as a condenser temperature.

A discharge pressure sensor 316 measures a pressure of liquid refrigerant output from the compressor 204. The pressure of refrigerant output by the compressor 204 can be referred to as a (compressor) discharge pressure.

A suction pressure sensor 320 measures a pressure of refrigerant input to the compressor 204 (e.g., in the suction line). The pressure of refrigerant input to the compressor 204 can be referred to as suction pressure.

A suction temperature sensor 324 measures a temperature of refrigerant input to the compressor 204 (e.g., in the suction line). The temperature of refrigerant input to the compressor 204 can be referred to as suction temperature.

A return air temperature sensor 328 measures a temperature of air flowing into the evaporator HEX 268. The temperature of air flowing into the evaporator HEX 268 may be referred to as a return air temperature.

A supply air temperature sensor 332 measures a temperature of air flowing out of the evaporator HEX 268. The temperature of air flowing out of the evaporator HEX 268 may be referred to as a supply air temperature.

An evaporator temperature sensor 336 measures a temperature of the evaporator HEX 268. For example, the evaporator temperature sensor 336 may measure the temperature of the evaporator HEX 268 at or near a midpoint of refrigerant flow through the evaporator HEX 268. The temperature of the evaporator HEX 268 can be referred to as an evaporator temperature.

An ambient air temperature sensor 340 measures a temperature of air outside of the refrigerated storage container 100. For example, the ambient air temperature sensor 340 may measure a temperature of air flowing into the condenser HEX 212. The temperature of the air outside of the refrigerated storage container 100 can be referred to as an ambient temperature.

One or more power sensors 390 may also be included. For example, the power sensors 390 may include line current sensors that measure line currents in each phase of power input to the refrigeration system 124. The power sensors 390 may additionally or alternatively include phase voltage sensors that measure phase voltages of the power input to the refrigeration system 124. The power sensors 390 may additionally or alternatively include frequency sensors that measure the frequencies of the power input to the refrigeration system 124.

Sensors described herein may be analog sensors or digital sensors. In the case of an analog sensor, the analog signal generated by the sensor may be sampled and digitized (e.g., by the control module 260, the drive 256, or another control module) to generate digital values, respectively, corresponding to the measurements of the sensor. In various implementations, the refrigeration system 124 may include a combination of analog sensors and digital sensors. The control module 260 controls actuators of the refrigeration system 124 based on various measured parameters, indications, setpoints, and other parameters.

For example, the control module 260 may control a speed of the electric motor 216 of the compressor 204 via the drive 256. The control module 260 may also control the condenser fan(s) 220. For example, one or more relays (R) 222 (FIG. 2) may be connected between the receptacle 128 and the condenser fan(s) 220. The control module 260 may control switching of the relay(s) 222 to control the speed of the condenser fan(s) 220. For example, the control module 260 may control the speed of a condenser fan using pulse width modulation (PWM) or analog control of a relay or an integrated fan control module. Increasing the on period of the PWM signal or the analog voltage applied to the integrated fan control module or relay increases the speed of the condenser fan. Conversely, decreasing the on period of the PWM signal or the analog voltage applied to the integrated fan control module or relay decreases the speed of the condenser fan. While the example of relays is provided, another suitable type of switching device may be used.

One or more of the condenser fan(s) 220 may be variable speed and/or one or more of the condenser fan(s) 220 may be fixed speed. For example, the condenser fan(s) 220 may include one fixed speed fan and one variable speed fan. For a fixed speed condenser fan, when the fan is to be ON, the control module 260 closes the associated relay and maintains the relay closed. For a variable speed fan, the control module 260 may determine a speed command and apply a PWM signal or analog voltage to the associated relay or integrated fan control module based on the speed command. The control module 260 may determine the ON period of the PWM signal or the analog voltage to apply, for example, using one of a lookup table and an equation that relates speed commands to on periods of PWM signals or analog voltages.

In the example of the expansion valve 264 being an EXV, the control module 260 may control opening of the expansion valve 264.

The control module 260 may receive a signal that indicates whether the HPCO 262 has tripped (open circuited). The control module 260 may take one or more remedial actions when the HPCO 262 has tripped, such as closing one, more than one, or all of the above mentioned valves, turning OFF one, more than one, or all of the above mentioned fans, turning off the blower 280, and/or turning OFF the electric motor 216. The control module 260 may generate an output signal indicating that the HPCO 262 has tripped when the discharge pressure of the compressor 204 is greater than a predetermined pressure. The control module 260 may re-enable operation of the refrigeration system 124 after the HPCO 262 closes in response to the discharge pressure falling below than the predetermined pressure. In various implementations, the control module 260 may also require that one or more operating conditions be satisfied before enabling operation of the refrigeration system 124 after the HPCO 262 closes.

The control module 260 may control the speeds of the blower 280. The blower 280 may be a variable speed blower, and the control module 260 may determine speed commands for the blower 280 and control the application of power to the blower 280 based on the speed command.

In various implementations, one or more of the above sensors may be omitted.

A clock 364 tracks a present time, such as in 12 or 24 hour format. The control module 260 monitors the present time and stores a set of the present (instantaneous) values measured by the sensors in memory 368 each predetermined period. For example, the control module 260 may store the set of values in the memory 368 each time the present time reaches an hour, such as 1:00, 2:00, 3:00, etc. The set values stored include the present value of the discharge pressure, the present value of the suction pressure, the present value of the condenser temperature, the present value of the suction temperature, the present value of the evaporator temperature, the present value of the return air temperature, the present value of the supply air temperature, the present value of the ambient air temperature, the present value of the setpoint temperature, the line currents, the phase voltages, and the frequencies. If a sensor of one of the values is omitted, that value may also be omitted from storage or a null or zero value may be stored for that value.

A cellular transceiver 372 transmits and receives data from a cellular network 374 via one or more antennas, such as antenna 376. For example, the cellular transceiver 372 transmits data to a health monitor server 380 via the cellular network 374. The cellular transceiver 372 also monitors a connection of the cellular transceiver 372 to the cellular network 374. For example, the cellular transceiver 372 may determine a received signal strength indication (RSSI) of the cellular transceiver 372 with the cellular network 374.

When the RSSI is greater than a predetermined value (e.g., 0), the cellular transceiver 372 may transmit the set of values to the health monitor server 380 when the set of values is stored. In other words, when the cellular transceiver 372 is connected to the cellular network 374, the cellular transceiver 372 may transmit the set of values to the health monitor server 380 each predetermined period when a set of values is stored. When the RSSI is less than or equal to the predetermined value, stored sets of values may remain in the memory 368 until connection of the cellular transceiver 372 to the cellular network 374 is re-established. The cellular transceiver 372 may lose connection to the cellular network 374, for example, when the ship 104 is at least a predetermined distance from land. The cellular transceiver 372 may re-establish connection with the cellular network 374, for example, when the ship 104 returns within the predetermined distance of land. While the example of cellular data transmission is provided, the present application is also applicable to other types of wireless communication, such as satellite communication or Bluetooth communication to another device which transmits data, for example, via a cellular or satellite network.

The cellular transceiver 372 may transmit a start of trip indicator to the health monitor server 380 at the beginning of a trip of the refrigerated storage container 100, such as when the refrigerated storage container 100 is loaded onto the ship 104 (e.g., from land). The cellular transceiver 372 may transmit an end of trip indicator to the health monitor server 380 at the end of the trip of the refrigerated storage container 100, such as when the refrigerated storage container 100 is unloaded from the ship 104 (e.g., to land). The cellular transceiver 372 may also transmit to the health monitor server 380 a set of the value at the start of the trip and a set of the values the end of the trip. Thus, the health monitor server 380 receives sets of values for the refrigerated storage container 100 from the start of the trip, the end of the trip, and each predetermined period between the start of the trip and the end of the trip. In various implementations, the cellular transceiver 372 may not transmit a start of trip indicator or an end of trip indicator to the health monitor server 380. Instead, the health monitor server 380 may identify the start of a trip and the end of the trip based on received data, such as locations of the refrigerated storage container 100 and/or other received parameters of the refrigerated storage container 100.

Once the refrigerated storage container 100 has reached the end of the trip, the health monitor server 380 determines a probability of health value for the refrigerated storage container 100. The probability of health value is indicative of a relative likelihood that the refrigerated storage container 100 can, in its current state, perform another trip without a pre-trip inspection (PTI) and/or repairs. A PTI includes a thorough inspection of an empty refrigerated storage container by one or more humans before a trip to verify that the refrigerated storage container and its components (e.g., the refrigeration system) are functional and not damaged.

The health monitor server 380 generates a recommendation of whether to perform a PTI of the refrigerated storage container 100 based on the probability of health value of the refrigerated storage container 100. For example, the health monitor server 380 may recommend the performance of a PTI of the refrigerated storage container 100 when the probability of health value of the refrigerated storage container 100 is less than a predetermined value. The health monitor server 380 may indicate that a PTI may not need to be performed for the refrigerated storage container 100 when the probability of health value of the refrigerated storage container 100 is greater than the predetermined value. The predetermined value may be, for example, approximately 92 where the probability of health values ranges from 0 to 100 with 100 corresponding to new refrigerated storage containers and 0 corresponding to faulty refrigerated storage containers.

Figure 4:
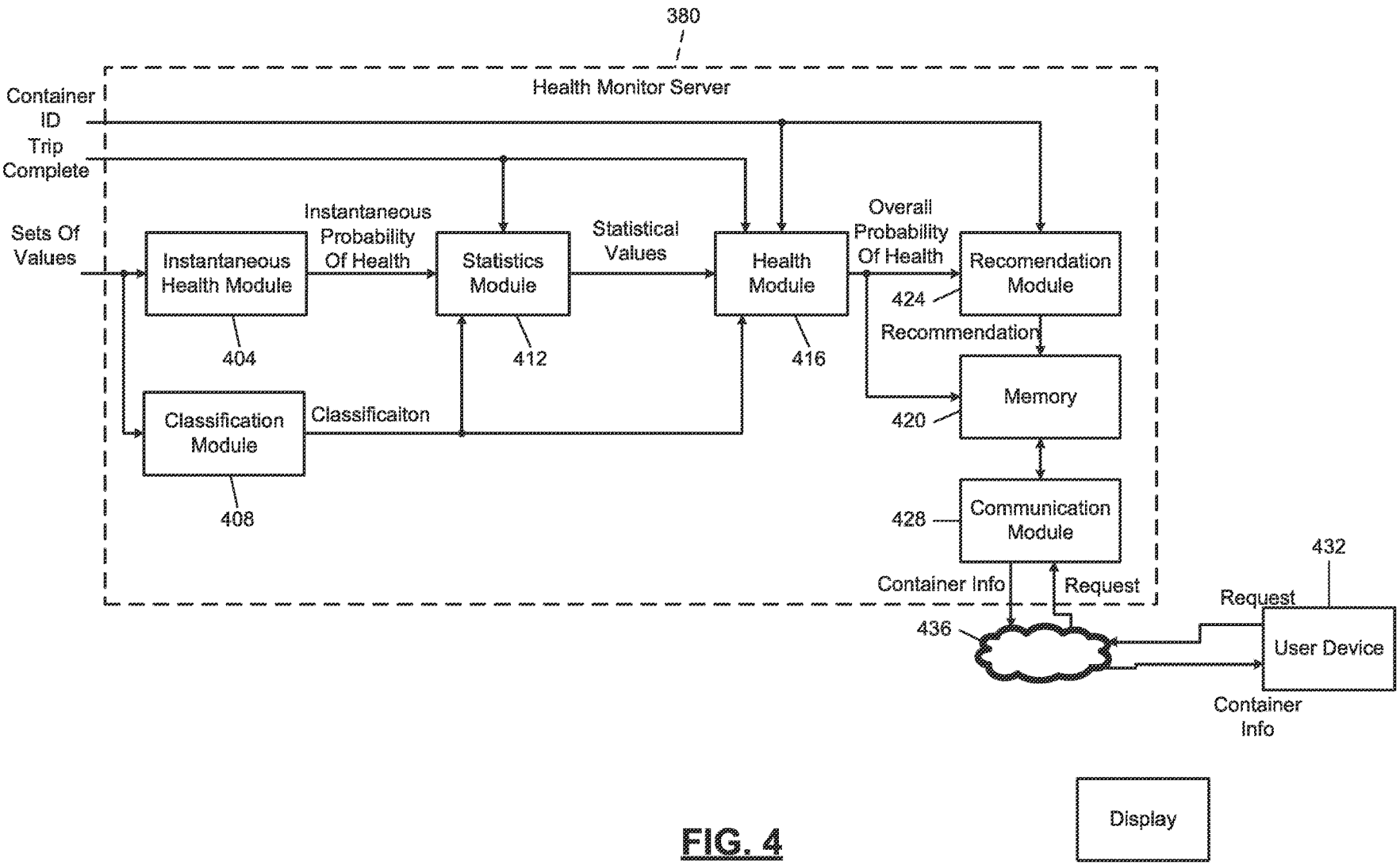
FIG. 4 is a functional block diagram of an example health monitor system including a health monitor server.

FIG. 4 is a functional block diagram of an example health monitor system including the health monitor server 380. An instantaneous health module 404 receives the sets of values from the cellular transceiver 372. The instantaneous health module 404 determines an instantaneous probability of health value for each set based on the values of that set of values. As stated above, each set of the values includes two, more than two, or all of: the present value of the discharge pressure, the present value of the suction pressure, the present value of the condenser temperature, the present value of the suction temperature, the present value of the evaporator temperature, the present value of the return air temperature, the present value of the supply air temperature, the present value of the ambient air temperature, the present value of the setpoint temperature, the present line currents, the present phase voltages, and the present frequencies. Based on the included ones of the values, the instantaneous health module 404 determines the instantaneous probability of health value for a set of values using at least one of a lookup table and an equation that relates discharge pressures, suction pressures, condenser temperatures, suction temperatures, evaporator temperatures, return air temperatures, supply air temperatures, ambient air temperatures, setpoint temperatures, line currents, phase voltages, and frequencies to instantaneous probability of health values. In various implementations, the instantaneous probability of health values may range from 0 corresponding to faulty refrigerated storage containers to 100 corresponding to new refrigerated storage containers. In various implementations, another suitable range for the probability of health values may be used.

A classification module 408 classifies each set of values as being taken either during pulldown or during steady-state operation. The classification module 408 may determine whether a set of values was taken during pulldown or during steady-state operation, for example, based on the evaporator temperature of the set. For example, the classification module 408 may classify a set of values as being taken during pulldown when the evaporator temperature of the set is greater than a predetermined temperature. The classification module 408 may classify a set of values as being taken during steady-state operation when the evaporator temperature is less than the predetermined temperature. While the example of using evaporator temperature to classify sets of values as being taken during steady-state operation or pulldown operation, supply air temperature may be used in place of evaporator temperature. In various implementations, another suitable parameter may be used to classify sets of values as being taken during steady-state operation or pulldown operation. While the example of FIG. 4 illustrates the classification being in parallel with the probability of health and statistics determinations, the sets of values may be classified before being input to the instantaneous health module.

Once the trip of the refrigerated storage container 100 is complete, a statistics module 412 determines statistical values for pulldowns and statistical values for steady-state operation. The statistics module 412 determines the statistical values for pulldowns based on the instantaneous probability of health values determined for sets of values taken during pulldown. The statistics module 412 determines the statistical values for steady-state operation based on the instantaneous probability of health values determined for sets of values taken during steady-state operation.

The statistics module 412 determines the set of the statistical values for steady state operation and determines a set of the statistical values for pulldown operation. The statistical values may include one, more than one, or all of a standard deviation of the instantaneous probability of health values, a median of the instantaneous probability of health values, a geometric mean of the instantaneous probability of health values, a harmonic mean of the instantaneous probability of health values, a kurtosis of the instantaneous probability of health values, a skewness of the instantaneous probability of health values, a median absolute deviation of the instantaneous probability of health values, a mean of the instantaneous probability of health values, a variance of the instantaneous probability of health values, a winsorized mean of the instantaneous probability of health values, a winsorized standard deviation of the instantaneous probability of health values, a pseudo standard deviation of the instantaneous probability of health values, and an inner quartile range of the instantaneous probability of health values. In various implementations, the statistical values include all of the standard deviation of the instantaneous probability of health values, the geometric mean of the instantaneous probability of health values, the median absolute deviation of the instantaneous probability of health values, and the winsorized standard deviation of the instantaneous probability of health values.

The standard deviation quantifies the extent of deviation from the mean for a group and reflects how much the instantaneous probability of health values deviate from the typical or central value. If the probability for a bad pulldown is low, one would expect a small standard deviation. A typical pulldown may go from bad to good very quickly and have a large standard deviation. The median is the center of a set of values based on order. The geometric mean is the Nth root of the product of n numbers. The geometric mean may provide useful insight, for example, if numbers make large fluctuations and/or if numbers in a series are not independent of each other (e.g., in time series). The geometric mean is robust to quick changes in instantaneous probability of health values. A normal mean may miss a refrigerated storage container that periodically drops to low probabilities throughout a trip. The harmonic mean is a reciprocal of the mean of the reciprocals of a set of data. The harmonic mean is sensitive to lower numbers. When looking at a distribution of values, the kurtosis corresponds to how sharp or curved the peak is. The kurtosis measures extreme values in either tail of a distribution. The skewness measures the asymmetry of a distribution. A positive value would indicate that a refrigerated storage container is more likely to have a higher probability of health value. The median absolute deviation is similar to a standard deviation but is in relation to the median. The median absolute deviation may be more robust to outliers as standard deviation varies more easily by extreme values. The median absolute deviation may be a more conservative look at variation around the center than standard deviation. If the median absolute deviation value agrees with the standard deviation, it could point to higher confidence that the refrigerated storage container should have a PTI or not. The variance is a measure of how far the probabilities are spread from the mean. The winsorized mean is a mean where extremes (outliers) are replaced with either the $10^{th}$ or $90^{th}$ percentile depending on the value. The winsorized standard deviation is a standard deviation where extremes (outliers) are replaced with either the $10^{th}$ or $90^{th}$ percentile depending on the value. The pseudo standard deviation is a standard deviation using the inner quartile range. The inner quartile range is a measure of spread calculated as the $75^{th}$ and $25^{th}$ quartile width.

A health module 416 determines an initial probability of health value for the refrigerated storage container 100 for pulldowns based on the statistical values determined for pulldowns. The health module 416 may determine the initial probability of health value using at least one of a lookup table and an equation that relates statistical values for pulldowns to initial probability of health values. The initial probability of health values may range from 0 corresponding to faulty refrigerated storage containers to 100 corresponding to new refrigerated storage containers. In various implementations, another suitable range for the probability of health values may be used.

In various implementations, the health module 416 may additionally or alternatively determine the initial probability of health value for the refrigerated storage container 100 for a pulldown based on the period necessary to complete the pulldown. For example, the health module 416 may set the initial probability of health value to a health value (e.g., at least a predetermined value, such as 92% or another suitable value) when the period is less than a predetermined period expected for the pulldown. The health module 416 may decrease the initial probability of health value for a pulldown as the period necessary to complete the pulldown becomes greater than the predetermined period.

The health module 416 also determines an initial probability of health value for the refrigerated storage container 100 for steady-state operation based on the statistical values determined for steady-state operation. The health module 416 may determine the initial probability of health value using at least one of a lookup table and an equation that relates statistical values for steady-state operation to initial probability of health values.

The health module 416 also determines an overall probability of health value for the refrigerated storage container 100 based on the initial probability of health value for pulldowns and the initial probability of health value for steady-state operation. The health module 416 may determine the overall probability of health value using at least one of a lookup table and an equation that relates initial probability of health values to overall probability of health values. For example only, the health module 416 may set the overall probability of health value based on or equal to an average of the initial probability of health values for pulldowns and steady-state operation. More specifically, the health module 416 may set the overall probability of health value for a trip based on the statistical probability of needed repair based on the results of previous trips in comparison to the resulting steady-state and pulldown probabilities from that trip. The overall probability of health value corresponds to a probability that the refrigerated storage container 100 will be fully functional throughout a next trip in its present state at the end of the present trip.

The health module 416 stores the overall probability of health value for the refrigerated storage container 100 in association with a unique identifier of the refrigerated storage container (container ID) in memory 420. Thus, the overall probability of health value of the refrigerated storage container 100 can be obtained via a call to the memory 420 including the unique identifier of the refrigerated storage container 100.

The overall probability of health value are determined and stored for multiple different refrigerated storage containers and trips in the memory 420. The overall probabilities of each refrigerated storage container may be stored with time stamps. This may enable the overall probability of health value of a refrigerated storage container to be tracked over time and multiple different trips.

A recommendation module 424 generates a recommendation regarding whether to perform a PTI (pre-trip inspection) of the refrigerated storage container 100 based on the overall probability of health value of the refrigerated storage container 100. For example, the recommendation module 424 may recommend performance of a PTI of the refrigerated storage container 100 when the overall probability of health value of the refrigerated storage container 100 is less than the predetermined value. The recommendation module 424 may recommend that no PTI of the refrigerated storage container 100 needs to be performed when the overall probability of health value of the refrigerated storage container 100 is greater than or equal to the predetermined value. The predetermined value may be, for example, approximately 92 where the probability of health values ranges from 0 to 100 with 100 corresponding to new refrigerated storage containers and 0 corresponding to faulty refrigerated storage containers. In various implementations, another suitable predetermined value may be used.

The recommendation module 424 stores the recommendation for the refrigerated storage container 100 in the memory 420 in association with the unique identifier of the refrigerated storage container 100. Thus, both the overall probability of health value of the refrigerated storage container 100 and the recommendation for the refrigerated storage container 100 can be obtained via a call to the memory 420 including the unique identifier of the refrigerated storage container 100.

A communication module 428 receives requests/calls for information from the memory 420 from requesting devices, retrieves the requested information from the memory 420, and provides the requested information to the requesting devices, respectively. For example, the communication module 428 may receive a request for the recommendation and the overall probability of health value for the refrigerated storage container 100 from a user device 432 via one or more networks 436, such as the Internet, a cellular network, a satellite network, etc. The user device 432 may generate and transmit the request, for example, in response to receiving user input to the user device 432 regarding the refrigerated storage container 100 or to the user device 432 scanning an identifier of the refrigerated storage container 100 located on an exterior surface of the refrigerated storage container 100. The identifier may be, for example, a barcode that is unique to the refrigerated storage container 100, a QR code that is unique to the refrigerated storage container 100, or another suitable type of optically recognizable object. The user device 432 may determine the unique identifier of the refrigerated storage container 100 based on the scanned identifier of the refrigerated storage container 100 and transmit the unique identifier of the refrigerated storage container 100 to the communication module 428 in the request. Alternatively, the user device 432 may transmit the scanned identifier to the communication module 428 in the request and the communication module 428 may determine the unique identifier of the refrigerated storage container 100 based on the scanned identifier.

Based on the request, the communication module 428 retrieves the overall probability of health value for the refrigerated storage container 100 and the recommendation (regarding whether to perform a PTI) for the refrigerated storage container 100 from the memory 420. The communication module 428 transmits the overall probability of health value for the refrigerated storage container 100 and the recommendation for the refrigerated storage container 100 to the user device 432. The user device 432 displays the overall probability of health value for the refrigerated storage container 100 and/or the recommendation for the refrigerated storage container 100 on a display. The display may be separate from the user device 432 or part of the user device 432. Based on the overall probability of health value for the refrigerated storage container 100 and/or the recommendation for the refrigerated storage container 100, a user of the user device 432 can send the refrigerated storage container 100 for a PTI prior to being packed for a next trip or allowed to be packed for a next trip without performance of a PTI.

Figure 5:
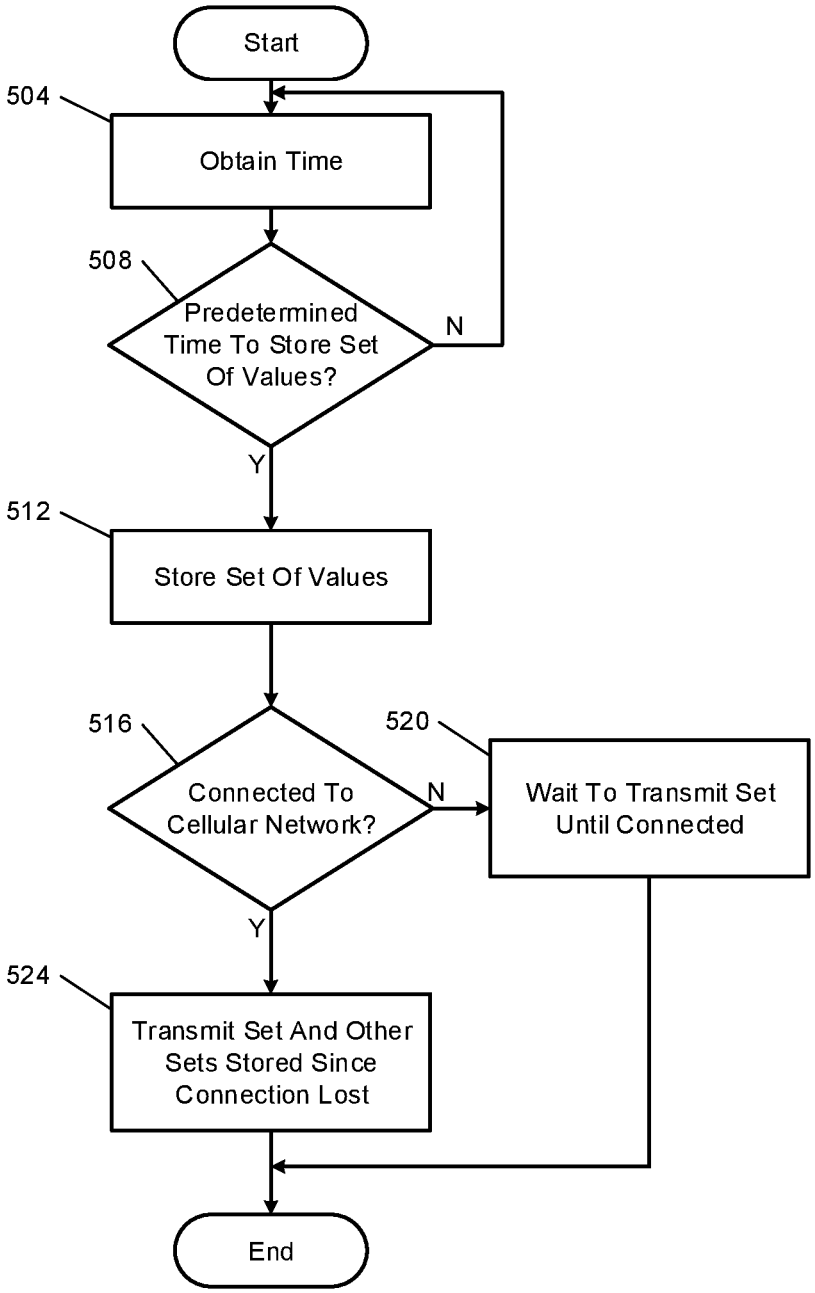
FIG. 5 is a flowchart depicting an example method of obtaining and transmitting sets of values from a refrigerated storage container to a health monitor server.

FIG. 5 is a flowchart depicting an example method of obtaining and transmitting sets of values to the health monitor server 380. Control begins with 504 where the control module 260 obtains the present time from the clock 364. At 508, the control module 260 determines whether a predetermined period has passed since the last time that a set of the present values was stored (e.g., 1 hour) or whether the present time is the same as a predetermined time (e.g., an hour, such as 1:00, 2:00, 3:00, etc.) when a set of the present values is to be stored. If 508 is true, control continues with 512. If 508 is false, control returns to 504.

At 512, the control module 260 stores the set of present values in the memory 368. The set values stored include the present value of the discharge pressure, the present value of the suction pressure, the present value of the condenser temperature, the present value of the suction temperature, the present value of the evaporator temperature, the present value of the return air temperature, the present value of the supply air temperature, the present value of the ambient air temperature, and the present value of the setpoint temperature. If a sensor of one of the values is omitted, that value may also be omitted from storage or a null or zero value may be stored for that value.

At 516, the cellular transceiver 372 determines whether the cellular transceiver 372 is connected to the cellular network 374. If 516 is false, at 520 the cellular transceiver 372 waits to transmit the stored set of the present values to the health monitor server 380. Sets of present values continued to be stored while 516 is false. If 516 is true, at 524 the cellular transceiver 372 transmits the stored set of the present values to the health monitor server 380. The cellular transceiver 372 may also transmit one or more other previously stored sets of the present values that were stored while the cellular transceiver 372 was not connected to the cellular network 374. While the example of FIG. 5 is shown as ending, control may return to 504. While the example of the instantaneous health module 404, the classification module 408, the statistics module 412, the health module 416, and the recommendation module 424 being within the health monitor server 380 is provided, one, more than one, or all of these modules may be implemented at the refrigerated storage container 100, such as in the control module 260.

Figure 6:
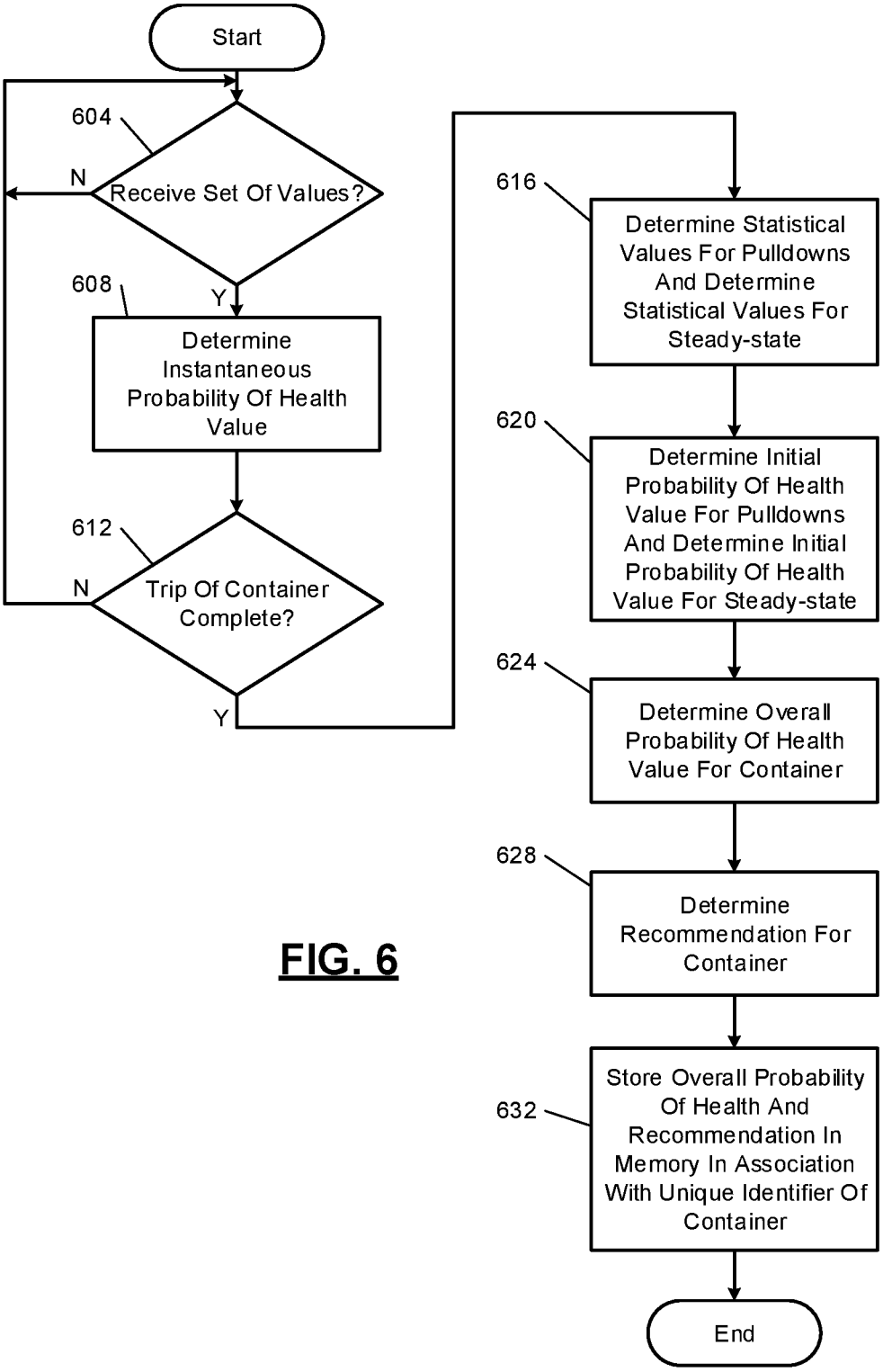
FIG. 6 is a flowchart depicting an example method of determining an overall probability of health value for a refrigerated storage container based on values obtained during a trip of the refrigerated storage container.

FIG. 6 is a flowchart depicting an example method of determining an overall probability of health value for the refrigerated storage container 100 based on the sets of the present values obtained during a (one) trip of the refrigerated storage container 100. Control begins with 604 where the instantaneous health module 404 determines whether a set of the present values has been received via the cellular network 374 from the refrigerated storage container 100. If 604 is true, control continues with 608. If 604 is false, control remains at 604.

At 608, the instantaneous health module 404 may determine an instantaneous probability of health value of the refrigerated storage container 100 based on the present values of the set of the present values. At 612, the statistics module 412 determines whether the trip of the refrigerated storage container 100 is complete. For example, the cellular transceiver 372 may transmit a trip complete signal (e.g., with a last set of the present values) when the trip of the refrigerated storage container 100 is complete. If 612 is true, control continues with 616. If 612 is false, control may return to 604.

At 616, the statistics module 412 determines the statistical values for pulldowns based on the instantaneous probability of health values during the trip for pulldowns. The statistics module 412 also determines the statistical values for steady-state operation based on the instantaneous probability of health values during the trip steady-state operation.

At 620, the health module 416 determines the initial probability of health value for pulldowns based on the statistical values for pulldowns. The health module 416 also determines the initial probability of health value for steady-state operation based on the statistical values for steady-state operation. At 624, the health module 416 determines the overall probability of health value for the refrigerated storage container 100 at the end of the trip based on the initial probability of health value for pulldowns and the initial probability of health value for steady-state operation.

At 628, the recommendation module 424 determines the recommendation for the refrigerated storage container 100 based on the overall probability of health value for the refrigerated storage container 100 at the end of the trip. For example, the recommendation module 424 may recommend performance of a PTI (pre-trip inspection) of the refrigerated storage container 100 when the overall probability of health value of the refrigerated storage container 100 is less than the predetermined value. The recommendation module 424 may recommend that no PTI of the refrigerated storage container 100 needs to be performed when the overall probability of health value of the refrigerated storage container 100 is greater than or equal to the predetermined value. The predetermined value may be, for example, approximately 92 where the probability of health values ranges from 0 to 100 with 100 corresponding to new refrigerated storage containers and 0 corresponding to faulty refrigerated storage containers. In various implementations, another suitable predetermined value may be used.

At 632, the health module 416 stores the overall probability of health value for the refrigerated storage container 100 in the memory 420 in association with the unique identifier of the refrigerated storage container 100. Also, the recommendation module 424 stores the recommendation for the refrigerated storage container 100 in the memory 420 in association with the unique identifier of the refrigerated storage container 100. While the example of FIG. 6 is shown as ending, control may return to 604.

Figure 7:
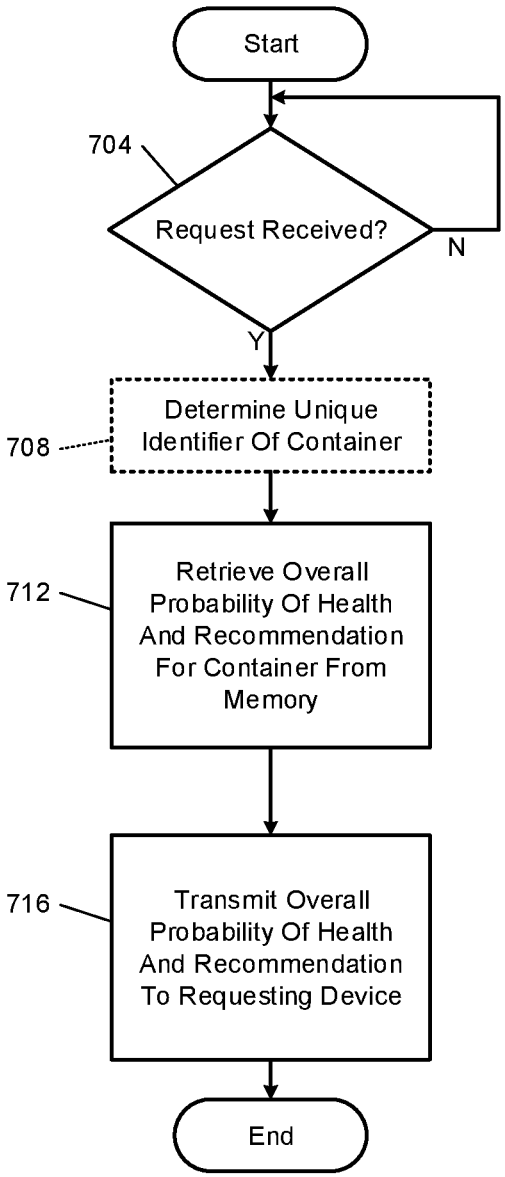
FIG. 7 is a flowchart depicting an example method of providing a health value and recommendation for a refrigerated storage container.

FIG. 7 is a flowchart depicting an example method of providing a health value and recommendation for the refrigerated storage container 100. Control begins with 704 where the communication module 428 determines whether a request for information on the refrigerated storage container 100 has been received, such as from the user device 432. If 704 is false, control remains at 704. If 704 is true, control continues with 708. The unique identifier of the refrigerated storage container 100 or a scanned identifier of the refrigerated storage container 100 may be included in the request.

At 708, the communication module 428 optionally determines the unique identifier of the refrigerated storage container 100 based on the scanned identifier of the refrigerated storage container 100. At 712, based on the unique identifier of the refrigerated storage container 100, the communication module 428 retrieves the overall probability of health value for the refrigerated storage container 100 and the recommendation for the refrigerated storage container 100 from the memory 420. At 716, the communication module 428 transmits the overall probability of health value for the refrigerated storage container 100 and the recommendation for the refrigerated storage container 100 from the memory 420 to device that sent the request, such as the user device 432. The user device 432 can display the overall probability of health value and/or the recommendation on a display, such as a display of the user device 432. While the example of FIG. 7 is shown as ending, control may return to 704.

In addition to the overall probability of health value of a trip and the unique identifier of the refrigerated storage container 100 being stored in the memory 420, a trip number for that trip may also be stored in the memory 420. As such, the memory 420 may include a (time) history of the overall probability of health for the refrigerated storage container 100 over time from trip to trip. The communication module 428 may transmit the entire history for the refrigerated storage container 100 in response to receipt of a request. The user device 432 may display, for example, a graph of the overall probability of health of the refrigerated storage container 100 for each trip.

Figure 8:
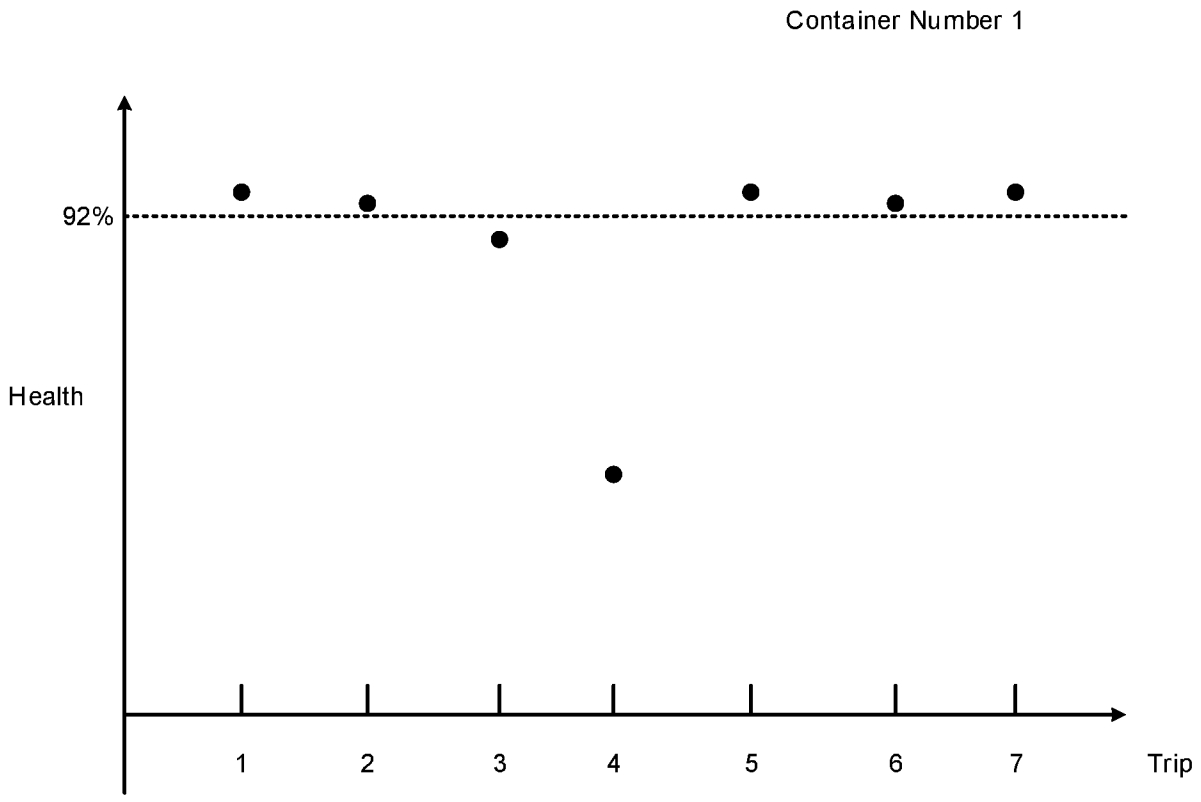
FIG. 8 includes an example graph of overall probability of health for each trip of a refrigerated storage container.

FIG. 8 includes an example graph of overall probability of health for each trip of refrigerated storage container number 1. In this example, the overall probability of health for refrigerated storage container 1 was higher than the predetermined value (e.g., 92%) for trips 1 and 2. For trip 3, the overall probability of health of the refrigerated storage container number 1 fell below the predetermined value, but not significantly. The overall probability of health of the refrigerated storage container number 1 was significantly lower than the predetermined value for trip 4. The overall probability of health for the refrigerated storage container number 1 returned to being greater than the predetermined value for trips 5, 6, and 7. This may indicate that the refrigerated storage container number 1 was repaired after trip 4.

In various implementations, a plurality of unique identifiers of multiple refrigerated storage containers may be stored in the memory 420 in association with an owner of those refrigerated storage containers. The communication module 428 may receive from the user device 432 a request for the (most recent) overall probability of health values for all of the refrigerated storage containers associated with the owner. In response, the communication module 428 may provide a list of the unique identifiers and the overall probability of health values, respectively, to the user device 432. The user device 432 may display on the display all of the overall probability of health values, such as on a graph. This may help the owner identify which ones of the refrigerated storage containers are most in need of repair or be used for one or more other reasons.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

In the figures, the direction of an arrow, as indicated by the arrowhead, generally demonstrates the flow of information (such as data or instructions) that is of interest to the illustration. For example, when element A and element B exchange a variety of information but information transmitted from element A to element B is relevant to the illustration, the arrow may point from element A to element B. This unidirectional arrow does not imply that no other information is transmitted from element B to element A. Further, for information sent from element A to element B, element B may send requests for, or receipt acknowledgements of, the information to element A.

In this application, including the definitions below, the term "module" or the term "controller" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks, flowchart components, and other elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language), XML (extensible markup language), or JSON (JavaScript Object Notation) (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective-C, Swift, Haskell, Go, SQL, R, Lisp, Java®, Fortran, Perl, Pascal, Curl, OCaml, Javascript®, HTML5 (Hypertext Markup Language 5th revision), Ada, ASP (Active Server Pages), PHP (PHP: Hypertext Preprocessor), Scala, Eiffel, Smalltalk, Erlang, Ruby, Flash®, Visual Basic®, Lua, MATLAB, SIMULINK, and Python®.

What is claimed is:

1. A system for monitoring health of refrigerated storage containers, comprising:

an instantaneous health module configured to determine instantaneous health values for a refrigerated storage container based on parameters measured by sensors of a refrigeration system of the refrigerated storage container during a trip of the refrigerated storage container;

a classification module configured to classify sets of the parameters as for pulldowns or for steady-state operation;

a statistics module configured to, after completion of the trip of the refrigerated storage container, determine:

first statistical values for pulldowns based on the instantaneous health values determined based on sets of the parameters for pulldowns; and second statistical values for steady-state operation based on the instantaneous health values determined based on sets of the parameters for steady-state operation; and a health module configured to:

determine a first initial health value based on the first statistical values for pulldowns;

determine a second initial health value based on the second statistical values for steady-state operation;

determine an overall health value for the refrigerated storage container at the completion of the trip based on the first and second initial health values; and store the overall health value for the refrigerated storage container in memory in association with a unique identifier of the refrigerated storage container.

2. The system of claim 1 where the parameters measured by the sensors include at least two of:

a condenser temperature measured by a condenser temperature sensor of the refrigeration system;

a discharge line temperature measured by a discharge line temperature sensor of the refrigeration system;

a return air temperature measured by a return air temperature sensor of the refrigeration system;

a supply air temperature measured by a supply air temperature sensor of the refrigeration system;

an evaporator temperature measured by an evaporator temperature sensor of the refrigeration system;

a suction temperature measured by a suction temperature sensor of the refrigeration system;

a suction pressure measured by a suction pressure sensor of the refrigeration system;

a discharge pressure measured by a discharge pressure sensor of the refrigeration system;

a fine current input to the refrigeration system;

a voltage input to the refrigeration system; and a frequency of a voltage input to the refrigeration system.

3. The system of claim 1 where the parameters measured by the sensors include all of:

a condenser temperature measured by a condenser temperature sensor of the refrigeration system;

a discharge fine temperature measured by a discharge line temperature sensor of the refrigeration system;

a return air temperature measured by a return air temperature sensor of the refrigeration system;

a supply air temperature measured by a supply air temperature sensor of the refrigeration system;

an evaporator temperature measured by an evaporator temperature sensor of the refrigeration system;

a suction temperature measured by a suction temperature sensor of the refrigeration system;

a suction pressure measured by a suction pressure sensor of the refrigeration system;

a discharge pressure measured by a discharge pressure sensor of the refrigeration system;

a line current input to the refrigeration system;

a voltage input to the refrigeration system; and a frequency of a voltage input to the refrigeration system.

4. The system of claim 3 wherein the instantaneous health module is configured to determine the instantaneous health values further based on an ambient temperature outside of the refrigerated storage container.

5. The system of claim 4 wherein the instantaneous health module is configured to determine the instantaneous health values further based on a setpoint temperature within the refrigerated storage container.

6. The system of claim 1 wherein the statistical values include:

a standard deviation of the instantaneous health values;

a geometric mean of the instantaneous health values;

a median absolute deviation of the instantaneous health values; and a winsorized standard deviation of the instantaneous health values.

7. The system of claim 1 wherein the statistical values include at least two of:

a standard deviation of the instantaneous health values;

a median of the instantaneous health values;

a geometric mean of the instantaneous health values;

a harmonic mean of the instantaneous health values;

a kurtosis of the instantaneous health values;

a skewness of the instantaneous health values;

a median absolute deviation of the instantaneous health values;

a mean of the instantaneous health values;

a variance of the instantaneous health values;

a winsorized mean of the instantaneous health values;

a winsorized standard deviation of the instantaneous health values;

a pseudo standard deviation of the instantaneous health values; and an inner quartile range of the instantaneous health values.

8. The system of claim 1 further comprising a recommendation module configured to:

set a recommendation for whether to perform a pre-trip inspection of the refrigerated storage container based on the overall health value of the refrigerated storage container; and store the recommendation in the memory in association with the unique identifier of the refrigerated storage container.

9. The system of claim 8 wherein the recommendation module is configured to:

set the recommendation to a first state when the overall health value of the refrigerated storage container is greater than a predetermined value; and set the recommendation to a second state when the overall health value of the refrigerated storage container is less than the predetermined value.

10. The system of claim 9 further comprising a communication module configured to:

receive a request including the unique identifier of the refrigerated storage container from a user device via a network;

based on the unique identifier included in the request, retrieve the overall health value of the refrigerated storage container and the recommendation for the refrigerated storage container from the memory; and transmit the overall health value and the recommendation to the user device via the network.

11. The system of claim 10 further comprising the user device, wherein the user device is configured to display on a display at least one of (i) the overall health value of the refrigerated storage container and (ii) the recommendation.

12. The system of claim 1 further comprising a communication module configured to:

receive a request including the unique identifier of the refrigerated storage container from a user device via a network;

based on the unique identifier included in the request, retrieve the overall health value of the refrigerated storage container from the memory; and transmit the overall health value to the user device via the network.

13. The system of claim 12 further comprising the user device, wherein the user device is configured to display the overall health value of the refrigerated storage container on a display.

14. A method for monitoring health of refrigerated storage containers, the method comprising:

determining instantaneous health values for a refrigerated storage container based on parameters measured by sensors of a refrigeration system of the refrigerated storage container during a trip of the refrigerated storage container;

classifying sets of the parameters as for pulldowns or for steady-state operation;

after completion of the trip of the refrigerated storage container, determining:

first statistical values for pulldowns based on the instantaneous health values determined based on sets of the parameters for pulldowns; and second statistical values for steady-state operation based on the instantaneous health values determined based on sets of the parameters for steady-state operation;

determining a first initial health value based on the first statistical values for pulldowns;

determining a second initial health value based on the second statistical values for steady-state operation;

determining an overall health value for the refrigerated storage container at the completion of the trip based on the first and second initial health values; and storing the overall health value for the refrigerated storage container in memory in association with a unique identifier of the refrigerated storage container.

15. The method of claim 14 further comprising receiving the parameters measured by the sensors, the parameters including at least two of:

a condenser temperature measured by a condenser temperature sensor of the refrigeration system;

a discharge line temperature measured by a discharge line temperature sensor of the refrigeration system;

a return air temperature measured by a return air temperature sensor of the refrigeration system;

a supply air temperature measured by a supply air temperature sensor of the refrigeration system;

an evaporator temperature measured by an evaporator temperature sensor of the refrigeration system;

a suction temperature measured by a suction temperature sensor of the refrigeration system;

a suction pressure measured by a suction pressure sensor of the refrigeration system;

a discharge pressure measured by a discharge pressure sensor of the refrigeration system;

a line current input to the refrigeration system;

a voltage input to the refrigeration system; and a frequency of a voltage input to the refrigeration system.

16. The method of claim 14 wherein determining the instantaneous health values includes determining the instantaneous health values further based on at least one of an ambient temperature outside of the refrigerated storage container and a setpoint temperature within the refrigerated storage container.

17. The method of claim 14 determining the statistical values includes determining at least two of:

a standard deviation of the instantaneous health values;

a median of the instantaneous health values;

a geometric mean of the instantaneous health values;

a harmonic mean of the instantaneous health values;

a kurtosis of the instantaneous health values;

a skewness of the instantaneous health values;

a median absolute deviation of the instantaneous health values;

a mean of the instantaneous health values;

a variance of the instantaneous health values;

a winsorized mean of the instantaneous health values;

a winsorized standard deviation of the instantaneous health values;

a pseudo standard deviation of the instantaneous health values; and an inner quartile range of the instantaneous health values.

18. The method of claim 14 further comprising:

setting a recommendation for whether to perform a pre-trip inspection of the refrigerated storage container based on the overall health value of the refrigerated storage container; and storing the recommendation in the memory in association with the unique identifier of the refrigerated storage container.

19. The method of claim 18 further comprising:

receiving a request including the unique identifier of the refrigerated storage container from a user device via a network;

based on the unique identifier included in the request, retrieving the overall health value of the refrigerated storage container and the recommendation for the refrigerated storage container from the memory; and transmitting the overall health value and the recommendation to the user device via the network.

20. The method of claim 19 further comprising displaying, on a display of the user device, at least one of the overall health value of the refrigerated storage container and the recommendation on a display.

* * * * *